US009943156B2

(12) United States Patent
Zhang et al.

(10) Patent No.: US 9,943,156 B2
(45) Date of Patent: Apr. 17, 2018

(54) COSMETIC AUTOMATIC SPRAYER

(71) Applicant: FENGHUA BIDA MACHINERY MANUFACTURE CO., LTD., Fenghua, Zhejiang (CN)

(72) Inventors: MingGui Zhang, Zhejiang (CN); WuJun Shen, Zhejiang (CN); MingKe Zhong, Zhejiang (CN); YuanFang Liang, Zhejiang (CN)

(73) Assignee: FENGHUA BIDA MACHNERY MANUFACTURE CO., LTD., Fenghua, Zhejiang (CN)

( * ) Notice: Subject to any disclaimer, the term of this patent is extended or adjusted under 35 U.S.C. 154(b) by 0 days.

(21) Appl. No.: 15/362,376

(22) Filed: Nov. 28, 2016

(65) Prior Publication Data

US 2018/0020805 A1 Jan. 25, 2018

(30) Foreign Application Priority Data

Jul. 20, 2016 (CN) ..... 2016 1 0581380

(51) Int. Cl.

| | |
|---|---|
| ***B05B 7/04*** | (2006.01) |
| ***B05B 7/06*** | (2006.01) |
| ***B05B 7/24*** | (2006.01) |
| ***B05B 11/00*** | (2006.01) |
| ***B05B 11/06*** | (2006.01) |
| ***B05B 12/00*** | (2018.01) |
| ***A45D 34/04*** | (2006.01) |

(Continued)

(52) U.S. Cl.

CPC ..... *A45D 34/04* (2013.01); *B05B 1/02* (2013.01); *B05B 1/30* (2013.01); *B05B 7/12* (2013.01); *B05B 11/0037* (2013.01); *B05B 11/06* (2013.01); *A45D 2200/057* (2013.01)

(58) Field of Classification Search

CPC ..... B05B 1/02; B05B 1/30; B05B 7/0416; B05B 7/0441; B05B 7/066; B05B 7/067; B05B 7/12; B05B 7/24; B05B 7/2402; B05B 7/2405; B05B 7/2416; B05B 7/2424; B05B 7/2478; B05B 11/0037; B05B 11/06; B05B 12/002; A45D 34/04; A45D 2200/057

See application file for complete search history.

(56) References Cited

U.S. PATENT DOCUMENTS 4,978,072 A * 12/1990 Kurowski ..... B05B 7/2413 239/346
6,105,881 A * 8/2000 Kitajima ..... B05B 1/00 239/353

(Continued)

*Primary Examiner* — Darren W Gorman

(57) ABSTRACT

The present invention relates to a cosmetic automatic sprayer; wherein the cosmetic automatic sprayer comprises a shell in which a cup for containing cosmetic liquid, wherein a spraying mechanism connected with the cup and an air pipe connected with the spraying mechanism are arranged, and further comprises a slidable button and a shifting fork; wherein the spraying mechanism comprises a handle body, a spraying needle, a nozzle, a spring, a locking nut, an end cover nut and a shifting block; wherein the shell comprises a liquid outlet through which liquid sprayed by the nozzle is sprayed out; and, wherein atomized cosmetic liquid can be evenly sprayed onto a person's face and easily absorbed by the skin, resulting in a optimal and efficient application of the cosmetic.

10 Claims, 4 Drawing Sheets

(51) Int. Cl.

| | |
|---|---|
| ***B05B 1/02*** | (2006.01) |
| ***B05B 1/30*** | (2006.01) |
| ***B05B 7/12*** | (2006.01) |

(56) References Cited

U.S. PATENT DOCUMENTS

| | | | | |
|---|---|---|---|---|
| 7,070,124 | B1 * | 7/2006 | Juo | B05B 7/064 239/340 |
| 7,448,557 | B2 * | 11/2008 | Ray | B05B 1/3046 222/326 |
| 2009/0266916 | A1 * | 10/2009 | Fedorov | B05B 1/3013 239/308 |
| 2011/0259978 | A1 * | 10/2011 | Ptak | B05B 7/0416 239/398 |
| 2012/0067977 | A1 * | 3/2012 | Spiegel | B05B 7/068 239/337 |
| 2014/0183280 | A1 * | 7/2014 | Mafi | B05B 7/0408 239/318 |
| 2016/0192760 | A1 * | 7/2016 | Nishiura | A45D 19/02 239/337 |
| 2017/0225184 | A1 * | 8/2017 | Lee | B05B 11/06 |

* cited by examiner

COSMETIC AUTOMATIC SPRAYER

BACKGROUND OF THE INVENTION

Technical Field

The invention relates to the technical field of cosmetic tools, in particular to a cosmetic automatic sprayer.

Description of Related Art

At present, liquid cosmetics such as liquid foundation, essences and toners are smeared on the face with one's hands, and the smearing method has the following disadvantages: (1) one's hands have to make contact with the cosmetics and generally need to be washed when smearing is completed; (2) manual smearing has the defect of being non-uniform, and the effect of the cosmetics is reduced; (3) time consumption of manual smearing is high, and the smearing efficiency is low.

BRIEF SUMMARY OF THE INVENTION

The invention aims to overcome the above disadvantages and provides a cosmetic automatic sprayer. According to the cosmetic automatic sprayer, cosmetic liquid is sprayed onto a person's face in an atomized way through a cup and a spraying mechanism, and thus the defects of the prior art are overcome.

The purposes of the invention are realized in the following way that: A cosmetic automatic sprayer comprises a shell and a cup for containing cosmetic liquid; a spraying mechanism connected with the cup and an air pipe connected with the spraying mechanism are both arranged in the shell; the cosmetic automatic sprayer further comprises a slidable button and a shifting fork; the spraying mechanism comprises a handle body, a spraying needle, a nozzle, a spring, a locking nut, an end cover nut and a shifting block. The two ends of the handle body communicate, and the nozzle is connected to one end of the handle body. The end cover nut is connected with the other end of the handle body, and the spraying needle is arranged on the handle body. One end of the spraying needle stretches out of the end cover nut, and the locking nut and the spring are both arranged on the spraying needle. The spring is located between the locking nut and the end cover nut. The shifting block is connected with the spraying needle, one end of the shifting fork is hinged to the shell, and the other end of the shifting fork makes contact with the shifting block. The button makes contact with the shifting fork; and, a liquid inlet and an air inlet are formed in the two sides of the handle body correspondingly, and the liquid inlet is connected with the cup. Additionally, the air inlet is connected with the air pipe, and the shell comprises a liquid outlet, and liquid sprayed by the nozzle is sprayed out through the liquid outlet.

The button comprises a button plate, a fixed plate and a sliding block; and, the button plate and the sliding block are connected in an integral structure. The fixed plate is located between the button plate and the sliding block; and, the shell is provided with a sliding groove and the button plate is arranged in the sliding groove.

A first toothed groove is formed in the surface of the fixed plate, facing the sliding block; and, a second toothed groove matched with the first toothed groove is formed in the surface of the sliding block, facing the fixed plate. The first toothed groove is engaged with the second toothed groove when the fixed plate is attached to the sliding block.

Elastic strips are arranged at the two ends of the surface of the button plate correspondingly, and the button plate makes contact with the fixed plate through the two elastic strips.

The shifting fork comprises two fork legs, and a through hole is formed in the middle of the shifting block. The spraying needle is sleeved with the shifting block through the through hole, and the spraying needle is further provided with a locking screw. The shifting block is fixed to the spraying needle through the locking screw and the locking nut, and the two ends of the shifting block stretch out of the two sides of the handle body. The two fork legs make contact with the two ends of the shifting block correspondingly.

An inner cavity of the handle body is provided with a liquid cavity and a sliding cavity. Additionally, a sealing ring is arranged between the liquid cavity and the sliding cavity, and the spraying needle is sleeved with the sealing ring.

Internal threads are arranged on the inner wall of the liquid inlet, and external threads are arranged at the connection end of the cup. The cup is connected with the handle body in a threaded mode through the connection end. Moreover, the cup is provided with a liquid adding port, wherein the liquid adding port comprises a cup plug, and the cup plug includes a check valve.

In another embodiment of the invention, the handle body comprises an air cock, wherein one end of the air cock is connected with the air inlet in a threaded mode, and the other end of the air cock is connected with the air pipe.

In another embodiment of the invention, the nozzle comprises a spraying head, wherein the spraying head comprises a spraying head jacket, and one end of the spraying head jacket stretches out of the liquid outlet.

In another embodiment of the present invention, the shell comprises a left shell body and a right shell body, wherein the left shell body and the right shell body are connected in a buckled mode. The liquid outlet is formed in the left shell body, and the right shell body comprises an upper right shell body part and a lower right shell body part. The upper right shell body part is movably connected with the left shell body and the lower right shell body part.

The invention has the beneficial effects that the cosmetic automatic sprayer is provided with a button, a cup, a spraying mechanism and an air pipe; when the cosmetic automatic sprayer is in use, the air pipe is connected with an air pump; and, when the button is slid, the button drives the spraying needle through the shifting fork to overcome the pressure of the spring to move so that a gap can be generated between the spraying needle and the nozzle; the cosmetic liquid in the cup then flows into the nozzle through the gap created between the spraying needle and the nozzle; after the air pump is initiated, the cosmetic liquid in the nozzle is rapidly dispersed by airflow, atomized and sprayed out along with the airflow. The atomized cosmetic liquid can then be evenly sprayed onto faces and easily absorbed by the skin, resulting in an optimal and efficient application of the cosmetic. The cosmetic automatic sprayer has the advantages of being easy to operate, good in smearing effect and highly efficient.

BRIEF DESCRIPTION OF THE SEVERAL VIEWS OF THE DRAWINGS

FIGS. 1-4: 1—shell, 11—liquid outlet, 12—left shell body, 13—right shell body, 131—upper right shell body part, 132—lower right shell body part, 2—cup, 3—spraying mechanism, 31—handle body, 311—liquid inlet, 312—air inlet, 313—liquid cavity, 314—sliding cavity, 315—air cock, 32—spraying needle, 33—nozzle, 331—spraying head, 34—spring, 35—locking nut, 36—end cover nut, 37—shifting block, 38—locking screw, 4—air pipe, 5—button, 51—button plate, 52—fixed plate, 521—first toothed groove, 53—sliding block, 531—second toothed groove, 54—elastic strip, 6—shifting fork, 61—fork leg, 7—sealing ring, 8—cup plug, 9—spraying head jacket

DETAILED DESCRIPTION OF THE INVENTION

Figure 1:
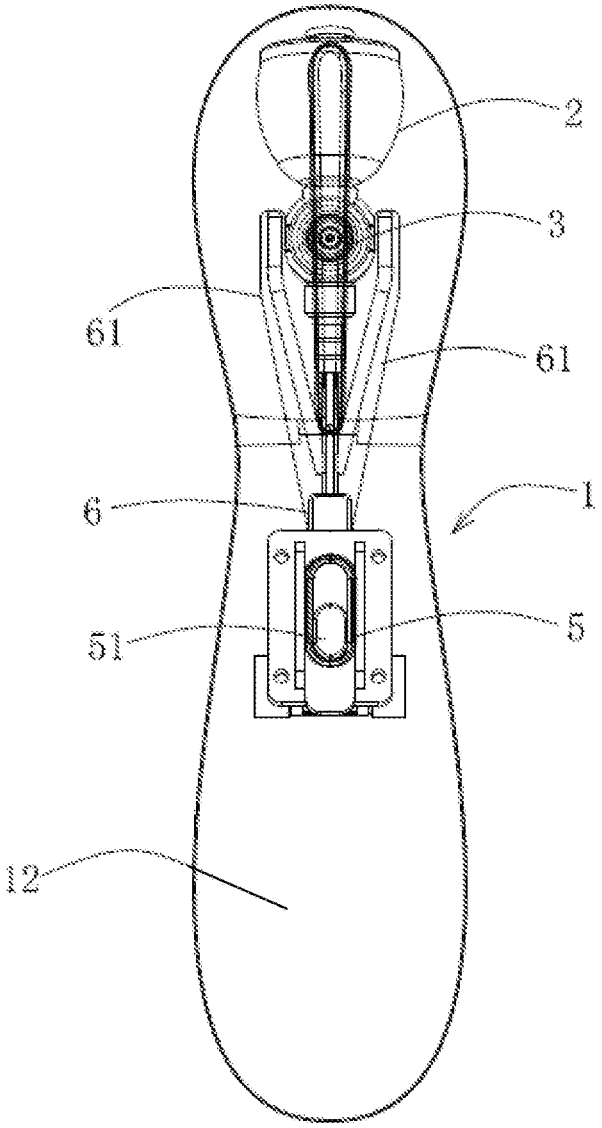
FIG. 1 is a structure schematic diagram of the invention.

A further detailed description of the specific embodiment of the invention is given with accompanying drawings as follows.

As is shown in FIGS. 1-4, a cosmetic automatic sprayer comprises a shell 1, and a cup 2 for containing cosmetic liquid. A spraying mechanism 3 connected with the cup 2 and an air pipe 4 connected with the spraying mechanism 3 are both arranged in the shell 1. The cosmetic automatic sprayer further comprises a slidable button 5 and a shifting fork 6; the spraying mechanism 3 also comprises a handle body 31, a spraying needle 32, a nozzle 33, a spring 34, a locking nut 35, an end cover nut 36, and a shifting block 37. The two ends of the handle body 31 communicate, and the nozzle 33 is connected with one end of the handle body 31. The end cover nut 36 is connected with the other end of the handle body 31, the spraying needle 32 is arranged on the handle body 31, and one end of the spraying needle 32 stretches out of the end cover nut 36. The locking nut 35 and the spring 34 are both arranged on the spraying needle 32, and the spring 34 is located between the locking nut 35 and the end cover nut 36. The shifting block 37 is connected with the spraying needle 32, and one end of the shifting fork 6 is hinged to the shell 1. The other end of the shifting fork 6 makes contact with the shifting block 37, and the button 5 makes contact with the shifting fork 6. A liquid inlet 311 and an air inlet 312 are formed in the two sides of the handle body 31 correspondingly. The liquid inlet 311 is connected with the cup 2, and the air inlet 312 is connected with the air pipe 4; the shell 1 is provided with a liquid outlet 11, and liquid sprayed by the nozzle 33 is sprayed out through the liquid outlet 11.

Figure 2:
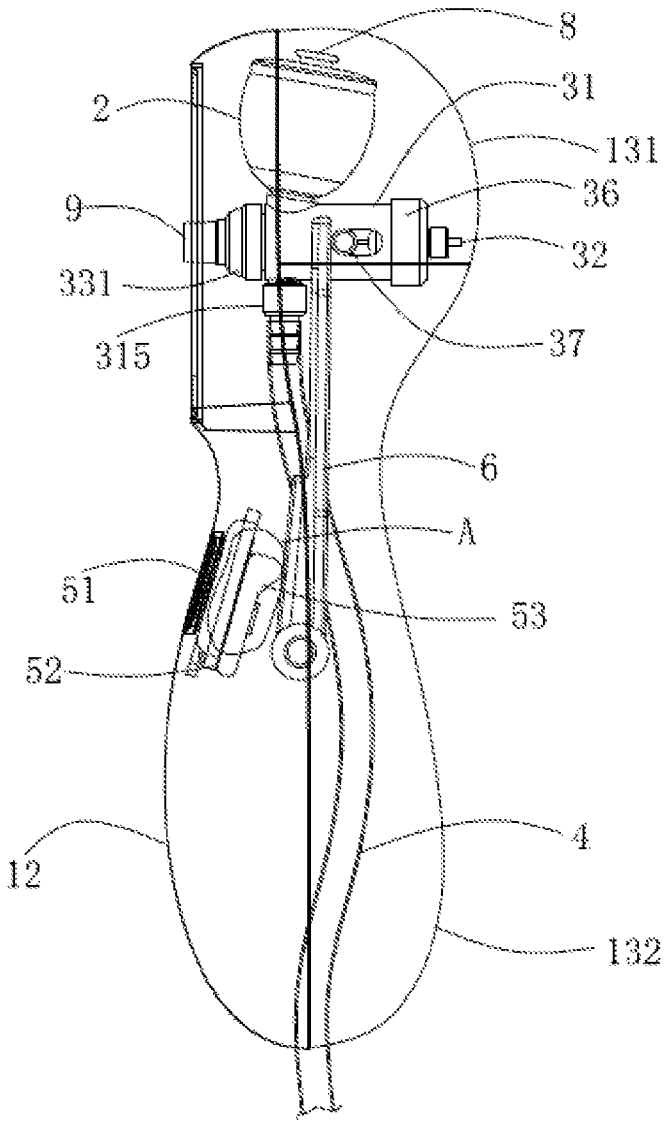
FIG. 2 is an internal structure schematic diagram of the invention.

The button 5 comprises a button plate 51, a fixed plate 52 and a sliding block 53. The button plate 51 and the sliding block 53 are connected into an integral structure, and the fixed plate 52 is located between the button plate 51 and the sliding block 53. The shell 1 is provided with a sliding groove, and the button plate 51 is arranged in the sliding groove. As shown in FIG. 2, the button plate 51 is pushed to move upwards. The sliding block 53 moves upwards along with the button plate 51, and the sliding block 53 squeezes the shifting fork 6.

A first toothed groove 521 is formed in the surface of the fixed plate 52, facing the sliding block 53. A second toothed groove 531 matched with the first toothed groove 521 is formed in the surface of the sliding block 53, facing the fixed plate 52. The first toothed groove 521 is engaged with the second toothed groove 531 when the fixed plate 52 is attached to the sliding block 53.

Elastic strips 54 are arranged at the two ends of the surface of the button plate 51 correspondingly, and the button plate 51 makes contact with the fixed plate 52 through the two elastic strips 54. When the button plate 51 slides to a certain position, the thumb is released, and the button plate 51 tensions the sliding block 53 under the effect of the elastic strips 54. The second toothed groove 531 in the sliding block 53 is made to engage with the first toothed groove 521 in the fixed plate 52, so that fixed-point positioning is achieved, and accordingly the controllability and comfort are improved.

The shifting fork 6 is provided with two fork legs 61. A through hole is formed in the middle of the shifting block 37, and the spraying needle 32 is sleeved with the shifting block 37 through the through hole. The spraying needle 32 is further provided with a locking screw 38, and the shifting block 37 is fixed to the spraying needle 32 through the locking screw 38 and the locking nut 35. The two ends of the shifting block 37 stretch out of the two sides of the handle body 31, and the two fork legs 61 make contact with the two ends of the shifting block 37 correspondingly. When the shifting fork 6 is pressed by the sliding block 53, as is shown in FIG. 2, the shifting fork 6 moves rightwards. The shifting block 37 then pushes the locking screw 35 and the spraying needle 32 is driven to move. In the backward moving process of the spraying needle 32, a gap is created between the spraying needle 32 and the nozzle 33. Liquid in the cup 2 flows to the outside through the gap between the spraying needle 32 and the nozzle 33.

An inner cavity of the handle body 31 comprises a liquid cavity 313 and a sliding cavity 314. A sealing ring 7 is arranged between the liquid cavity 313 and the sliding cavity 314, and the spraying needle 32 is sleeved with the sealing ring 7.

Internal threads are arranged on the inner wall of the liquid inlet 311. External threads are arranged at the connection end of the cup 2, and the cup 2 is connected with the handle body 31 in a threaded mode through the connection end. The cup 2 is provided with a liquid adding port 21. The liquid adding port 21 is provided with a cup plug 8, and the cup plug is provided with a check valve. Cosmetic liquid can be added into the cup 2 through the liquid adding port 21 by removing the cup plug 8. Additionally, the check valve has an anti-leakage function.

The handle body 31 comprises an air cock 315; one end of the air cock 315 is connected with the air inlet 312 in a threaded mode, and the other end of the air cock 315 is connected with the air pipe 4.

The nozzle 33 is provided with a spraying head 331; and, the spraying head 331 is provided with a spraying head jacket 9. One end of the spraying head jacket 9 stretches out of the liquid outlet 11.

The shell 1 comprises a left shell body 12 and a right shell body 13, the left shell body 12 and the right shell body 13 are connected in a buckled mode, the liquid outlet 11 is formed in the left shell body 12, the right shell body 13 comprises an upper right shell body part 131 and a lower right shell body part 132, and the upper right shell body part 131 is movably connected with the left shell body 12 and the lower right shell body part 132. The upper right shell body part 131 can be dismounted independently, the cup 2 can be exposed after the upper right shell body part 131 is removed, and then the cosmetic liquid can be added into the cup 2 through the liquid adding port 21. Through the design, a user can add the cosmetic liquid conveniently.

Figure 3:
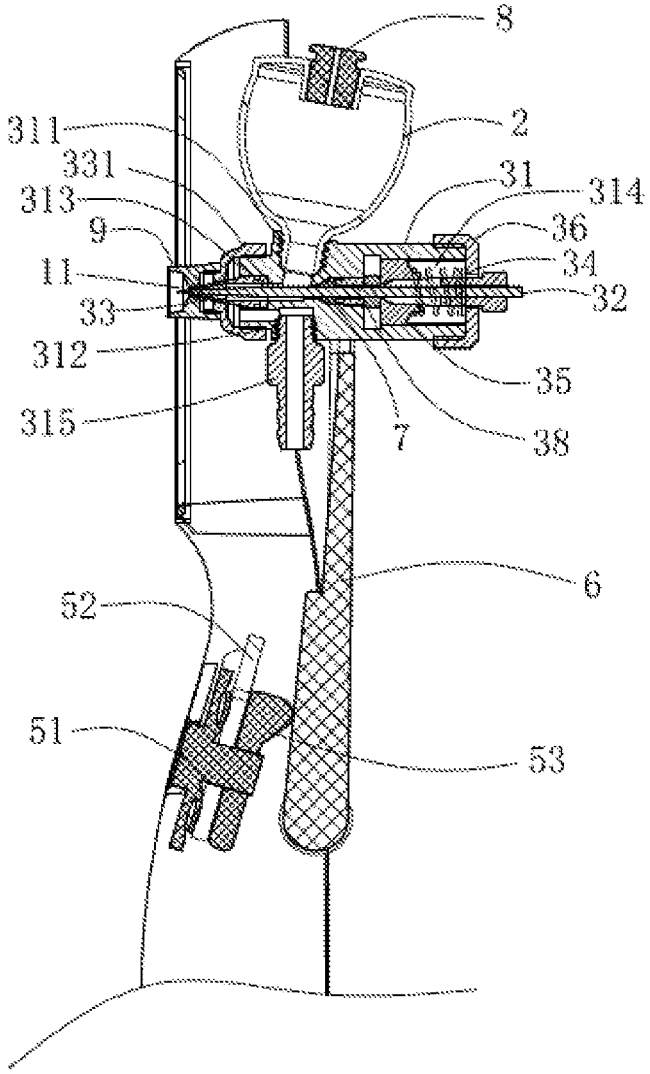
FIG. 3 is a local sectional view of the invention.
Figure 4:
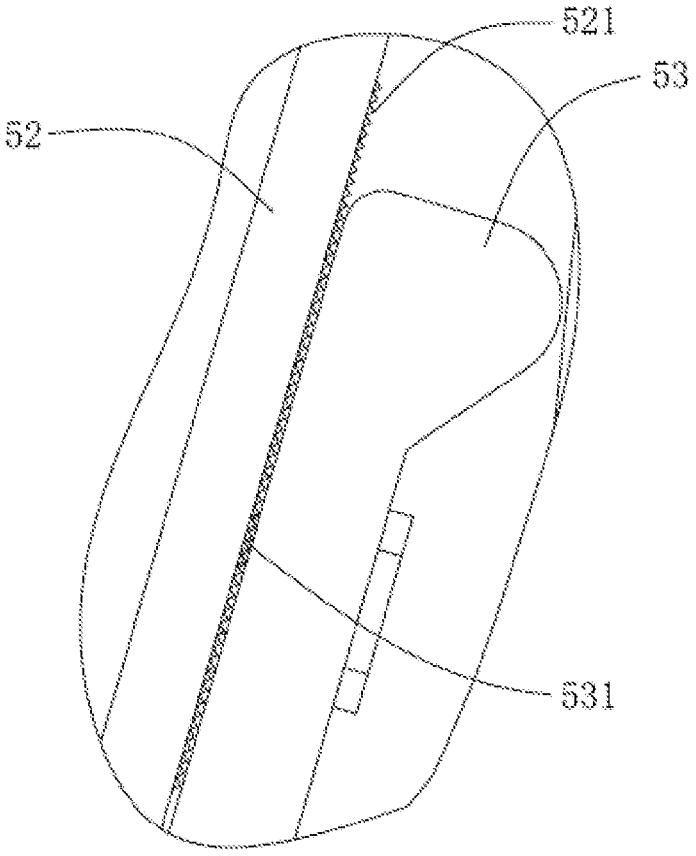
FIG. 4 is an enlarged schematic diagram of an A portion of the invention.

According to the operating principle, as is shown in FIG. 2 and FIG. 3, when in use, the cosmetic automatic sprayer needs to be matched with an air source device (not shown in the FIGs). The air pipe 4 is connected with the air source device 4, and the button plate 51 is pressed to slide upwards. The sliding block 53 connected with the button plate 51 is driven to slide, and the sliding block 53 abuts against the shifting fork 6 to make the shifting fork 6 move rightwards. The shifting fork 6 pushes the shifting block 37 to move rightwards, and the shifting block 37 drives the locking nut 35. The locking screw 38 and the spraying needle 32 then move rightwards synchronously. A gap is created between the spraying needle 32 and the nozzle 33 in the rightward moving process of the spraying needle 32. Liquid is rapidly dispersed and atomized by airflow passing through the nozzle 33 when flowing into the nozzle 33, and the liquid is sprayed to the outside along with the airflow.

The further detailed description of the invention is given in the above content with the specific preferred embodiment, however, specific embodiments of the invention are not limited to the above description. For those skilled in the technical field of the invention, various simple deductions or substitutes can be made without deviating from the concept of the invention and are all within the protection scope of the invention.

What is claimed is:

1. A cosmetic automatic sprayer, comprising:

a shell which further comprising a cup for containing cosmetic liquid;

a spraying mechanism connected with the cup;

an air pipe connected with the spraying mechanism, wherein the cosmetic automatic sprayer further comprises a slidable button and a shifting fork, wherein the spraying mechanism comprises a handle body, a spraying needle, a nozzle, a spring, a locking nut, an end cover nut, and a shifting block, wherein the handle body has two ends, wherein the nozzle is connected with one end of the handle body, wherein the end cover nut is connected with the other end of the handle body, wherein the spraying needle is disposed inside the handle body, wherein one end of the spraying needle extends out of the end cover nut, wherein the locking nut and the spring are both arranged on the spraying needle, wherein the spring is located between the locking nut and the end cover nut, wherein the shifting block is connected with the spraying needle, wherein one end of the shifting fork is hinged to the shell, and the other end of the shifting fork makes contact with the shifting block, and wherein the button makes contact with the shifting fork, wherein the handle body has two sides, wherein a liquid inlet and an air inlet are formed in the two sides of the handle body correspondingly, wherein the liquid inlet is connected with the cup, and the air inlet is connected with the air pipe, wherein the shell is provided with a liquid outlet, and liquid sprayed by the nozzle is sprayed out through the liquid outlet.

2. The cosmetic automatic sprayer according to claim 1, wherein the button further comprises a button plate, a fixed plate and a sliding block, wherein the button plate and the sliding block are connected into an integral structure, wherein the fixed plate is located between the button plate and the sliding block, wherein the shell is provided with a sliding groove, and the button plate is arranged in the sliding groove.

3. The cosmetic automatic sprayer according to claim 2, wherein a first toothed groove is formed in a surface of the fixed plate and faces the sliding block, wherein a second toothed groove matched with the first toothed groove is formed in a surface of the sliding block and faces the fixed plate, wherein the first toothed groove is engaged with the second toothed groove when the fixed plate is attached to the sliding block.

4. The cosmetic automatic sprayer according to claim 2, wherein the button plate has a surface with two ends, wherein a elastic strip is arranged at each of the two ends of the surface of the button plate correspondingly, and the button plate makes contact with the fixed plate through the two elastic strips.

5. The cosmetic automatic sprayer according to claim 1, wherein the shifting fork comprises two fork legs, and wherein a through hole is formed in the middle of the shifting block, and wherein the spraying needle is sleeved with the shifting block through the through hole, wherein the spraying needle further comprises a locking screw, wherein the shifting block is fixed to the spraying needle through the locking screw and the locking nut, wherein the shifting block has two ends, wherein the two ends of the shifting block extend out of the two sides of the handle body, and wherein the two fork legs make contact with the two ends of the shifting block correspondingly.

6. The cosmetic automatic sprayer according to claim 1, further comprising an inner cavity of the handle body having a liquid cavity and a sliding cavity, wherein a sealing ring is arranged between the liquid cavity and the sliding cavity, wherein the spraying needle is sleeved with the sealing ring.

7. The cosmetic automatic sprayer according to claim 1, further comprising internal threads that are arranged on the inner wall of the liquid inlet, and external threads that are arranged at a connection end of the cup, wherein the cup is connected with the handle body in a threaded mode through the connection end, wherein the cup comprises a liquid adding port, wherein the liquid adding port is provided with a cup plug, and the cup plug is provided with a check valve.

8. The cosmetic automatic sprayer according to claim 1, wherein the handle body further comprising an air cock, wherein one end of the air cock is connected with the air inlet in a threaded mode, and the other end of the air cock is connected with the air pipe.

9. The cosmetic automatic sprayer according to claim 1, wherein the nozzle furthering comprising a spraying head, wherein the spraying head is provided with a spraying head jacket, wherein one end of the spraying head jacket extends out of the liquid outlet.

10. The cosmetic automatic sprayer according to claim 1, wherein the shell further comprising a left shell body and a right shell body, wherein the left shell body and the right shell body are connected in a buckled mode, wherein the liquid outlet is formed in the left shell body, wherein the right shell body comprises an upper right shell body part and a lower right shell body part, wherein the upper right shell body part is movably connected with the left shell body and the lower right shell body part.

* * * * *